United States Patent [19]

Fono et al.

[11] 4,113,427

[45] Sep. 12, 1978

[54] PROCESS FOR DYEING CELLULOSIC TEXTILES WITH VAT AND SULFUR DYES

[75] Inventors: Andrew Fono, Montclair, N.J.; Ray F. Patton, Burlington, N.C.

[73] Assignee: Royce Chemical Company, East Rutherford, N.J.

[21] Appl. No.: 680,198

[22] Filed: Apr. 26, 1976

[51] Int. Cl.[2] ..... C09B 9/00; C09B 49/00; D06P 1/22

[52] U.S. Cl. ..... 8/34; 8/37; 8/38; 8/54.2; 8/89 R; 8/93

[58] Field of Search ..... 8/34, 54.2, 89 R, 93, 8/37, 38

[56] References Cited

U.S. PATENT DOCUMENTS

| | | | |
|---|---|---|---|
| 3,000,688 | 9/1961 | Schubert et al. | 8/34 |
| 3,118,724 | 1/1964 | Goerrig et al. | 8/34 |
| 3,171,711 | 3/1965 | Alsberg et al. | 8/74 |
| 3,265,459 | 8/1966 | Schober et al. | 8/34 |
| 3,798,172 | 3/1974 | Etters | 252/188 |
| 3,804,944 | 4/1974 | Kise et al. | 423/265 |
| 3,839,217 | 10/1974 | Owen et al. | 8/37 |
| 3,839,218 | 10/1974 | Owen et al. | 8/37 |

FOREIGN PATENT DOCUMENTS 829,177 4/1960 United Kingdom.

OTHER PUBLICATIONS

Textile World, Mar. 1961, p. 82.

M. R. Fox, "Vat Dyestuffs and Vat Dyeing" (John Wiley, New York, 1948) pp. 37–38.

Brearley and Starkie, J. Soc. Dyers and Col., Aug. 1948, pp. 278–283.

*Primary Examiner*—A. Lionel Clingman

*Attorney, Agent, or Firm*—Brumbaugh, Graves, Donohue & Raymond

[57] ABSTRACT

The specification describes an improved process for dyeing cellulosic textiles with vat and sulfur dyes using a reducing agent composition which has been stabilized against aerobic and anaerobic decomposition. This specification describes also the reducing agent composition which comprises sodium dithionite and a critical amount of sodium hydroxymethanesulfinate.

16 Claims, No Drawings

PROCESS FOR DYEING CELLULOSIC TEXTILES WITH VAT AND SULFUR DYES

In the past, sodium dithionite, known also as sodium hydrosulfite and hydro, has been employed as a reducing agent for dyeing cellulosic textiles with vat and sulfur dyes (U.S. Pat. No. 3,798,172, which is incorporated herein by reference). A reducing agent is used in textile dyeing processes to convert the dyestuff into its soluble reduced state which is necessary to penetrate cellulosic textiles. Sodium dithionite, however, decomposes rapidly in the presence or absence of air. Therefore, large excesses of this compound have been required to reduce all of the dyestuff and to maintain the dyestuff in its soluble form throughout the dyeing process.

Numerous attempts have been made to stabilize sodium dithionite against decomposition and thereby reduce the amount of reducing agent required for dyeing cellulosic textiles [U.S. Pat. Nos. 3,645,665, 3,798,172 and 3,804,944; Etters, *Textile Chemist and Colorist,* 4, 83 (1972); Etters, *Textile Chemist and Colorist,* 7, 209 (1975); and Shah, *Textile Chemist and Colorist,* 4, 268 (1972) ].

Sodium hydroxymethanesulfinate, known also as sodium formaldehyde sulfoxylate, and other sulfinic acid derivatives have been used as reducing agent for vat and sulfur dyes (U.S. Pat. No. 3,265,459 and British Pat. Nos. 873,940 and 829,177, which are incorporated herein by reference). In many commercial applications, however, these compounds, alone, react too slowly as reducing agents for vat and sulfur dyes.

It has now been discovered that the combination of sodium dithionite with a critical amount of sodium hydroxymethanesulfinate greatly improves the quality and appearance of the dyed cellulosic textile, and reduces the amount of sodium dithionite required to reduce vat and sulfur dyes. The reducing agent composition of the present invention comprises by weight about 85–99% sodium dithionite and about 1–15% sodium hydroxymethanesulfinate. In a preferred embodiment, the reducing agent composition comprises by weight about 90–95% sodium dithionite and about 5–10% sodium hydroxymethanesulfinate.

As defined herein, a vat and sulfur dye is a dyestuff which is soluble in its reduced state in aqueous alkaline solution, e.g., indigo dyes and quinone dyes. These dyes are well known in the art [*Hackh's Chemical Dictionary,* 227 (4th ed. 1969) which is incorporated herein by reference].

The term "cellulosic textile" as defined herein includes without limitation all-cotton fabrics and yarns, or fabrics and yarns containing cotton blended with synthetic or other fibers such as rayon, polyester, and polyacrylonitrile fibers and covers any yarn, rawstock of such fibers or any such fabric whether woven or knitted. These textiles are also well known in the art (U.S. Pat. No. 3,798,172, which is incorporated herein by reference).

The reducing agent composition of the present invention may be prepared for use in textile dyeing processes either as a dry solid composition or as an aqueous solution. In solid form, the reducing agent composition usually contains about 5–15% of an anti-caking agent, such as sodium carbonate. In an aqueous solution, a concentration of about 1–15% reducing agent composition may be utilized.

For many dyeing processes, an oxidation retarder may be added to the reducing agent composition as a further means of controlling the rate of decomposition of the reducing agent. Suitable oxidation retarders include without limitation the aldehyde-bisulfite addition products, such as the acetaldehyde-bisulfite addition product, described in U.S. Pat. Nos. 3,654,665 and 3,798,172, which are incorporated herein by reference. When employed, the amount of oxidation retarder is about 10–70% by weight of the reducing agent composition.

Depending on the dyeing process used, other optional ingredients may be added to the reducing agent composition to facilitate dyeing. For example, a surface active agent or detergent, such as Nekal NF, may be added to reduce surface tension and to wet the cellulosic textile. A chelating agent, such as ethylenediaminetetraacetic acid and salts thereof, may be added to complex iron and other heavy metal ions. Also, sodium chloride may be added to increase the affinity of the dyestuff for the cellulosic textile. Finally, a thickening agent, such as the polymeric material described in Etters, *Textile Chemist and Colorist,* 7, 209 (1975), which is incorporated herein by reference, may be added where it is advantageous to increase the viscosity of the reducing agent composition solution.

The reducing agent composition of the invention may be used in a wide variety of known vat and sulfur dyeing processes including without limitation both batch and continuous dyeing processes, such as the pad-steam, pad-batch, package, beam, long-bath, Beck and jig processes. The reducing agent composition of the invention may be applied to the cellulosic textile concurrently with the dyestuff or it may be added to the dyebath after the dyestuff has been added. The total amount of reducing agent composition required can be determined by simple experimentation, and will depend on the particular process, dyestuff, and cellulosic textile involved.

The pH of the reducing agent composition solution during dyeing must be maintained generally in the range of about 10–13. To accomplish this, any well known alkaline material, which will not interfere with the dyeing process, may be added to the reducing agent composition solution. Among those compounds suitable for most dyeing processes are sodium hydroxide, sodium carbonate, calcium hydroxide, sodium silicate and mixtures thereof. Any amount of alkaline material which will maintain the pH of the dyebath in the range of about 10–13 may be employed, such as about 50–200% of the reducing agent composition.

Any suitable temperature or time which effects dyeing may be used. Generally, temperatures will range from about 25° to 110° C. Typical process times range from about 15 seconds to about 2 hours.

Using the reducing agent composition of the invention, the end product obtained is a dyed cellulosic textile having improved wet fastness properties, such as wash fastness and wet crock fastness. Depending on the process and conditions used, the relative color yield, which is determined visually by experts in the field, may increase in an amount up to 50% by employing the reducing agent composition of the invention. In addition, the use of the reducing agent composition also may result in a potential dyestuff saving in an amount up to 25%. Furthermore, shade control becomes easier, and dyeing time is reduced. Also, the amount of sodium dithionite required for optimum dyeing may be reduced in an amount as much as 20–40%.

The following examples are submitted to illustrate but not to limit the invention. Unless otherwise indicated, all parts and percentages in the specification and claims are based on weight.

EXAMPLE 1

The criticality of the amount of sodium hydroxymethanesulfinate was demonstrated in the laboratory by comparing the color of dyed textile using a series of reducing agent compositions comprising sodium dithionite and sodium hydroxymethanesulfinate. Cotton was dyed with indigo at low temperatures according to the long-bath method. Six separate reducing agent compositions were prepared containing sodium dithionite and 0% (control), 5, 10, 15, 20 and 25% sodium hydroxymethanesulfinate by weight, respectively. Dyeings were performed with each reducing agent composition at 35°, 45°, 55°, and 65° C. For each temperature, the color yield obtained with the reducing agent composition containing 5%, 10% and 15% sodium hydroxymethanesulfinate was higher than the color yield for the control. For all tests with the composition containing 20 and 25% sodium hydroxymethanesulfinate the color yield was lower than the color yield for the control.

The above laboratory experiment was repeated using the pad-steam process in place of the long-bath method. The highest color yield was obtained with the reducing agent composition containing 5 and 10% sodium hydroxymethanesulfinate, Furthermore, increasing the total amount of the reducing agent composition did not result in any additional increase in color yield, indicating that sufficient reducing agent was present in all cases.

EXAMPLE 2

A solid reducing agent composition of the invention was prepared for use on a commercial scale using the following amounts of ingredients: 8000 pounds of sodium dithionite, 800 pounds of commercial crystalline sodium hydroxymethanesulfinate (90% pure), 800 pounds of sodium carbonate, and 400 pounds of sodium chloride. Dyeings with this reducing agent composition were compared with a control consisting of commercial grade sodium dithionite (90% pure), the remainder being sodium carbonate and sodium chloride.

The above reducing agent composition was employed to dye cotton yarn in a pad-bath dyeing process. Eighteen pounds of Anthraquinone Vat Blue #6 and 1 pound Nekal NF wetting agent were added to 300 gallons of water at 60° C. The resulting solution was circulated for 20 minutes in a pad-batch yarn dyeing machine containing 300 pounds of yarn. Eighteen pounds of sodium hydroxide and eighteen pounds of the reducing agent composition were added and circulated for an additional 40 minutes. The results using the reducing agent composition of the invention were compared with those with the sodium dithionite control. The following results were obtained:

Table 1

| | Reducing Agent | |
|---|---|---|
| | Invention | Control |
| Wet Crock AATCC Test Rating | 5 | 3–4 |
| No. 4 Wash Fastness AATCC Test Rating | 5 | 3–4 |

The above results show the superiority of the reducing agent composition of the invention as compared with the sodium dithionite control. In addition, the relative color yield increased 5%, shade was brighter, and wet fastness was superior with the reducing agent composition of the invention.

Comparable wet fastness results can be obtained using the reducing agent composition of the invention in the above pad-batch and in beam dyeing processes with the following dyes and mixtures thereof: Vat Green #1, #3; Vat Black #25, #27; Vat Blue #14, #18, #20; Vat Orange #2, #7, #15; Vat Brown #1, #3, #11; Vat Red #1, #15; and Vat Violet #2, #3, #9.

EXAMPLE 3

The reducing agent composition described in Example 2 was employed in a pad-steam continuous dyeing process to dye terry cloth in a wet-on-wet process and a corduroy and twill blend in a wet-on-dry process.

To dye both fabrics, the following materials were added to a 50 gallon dye pad: 6.4 oz/gallon Vat Orange 7 and 0.25 oz/gallon Nekal NF wetting agent. The following materials were added to the chemical dye pad: 5.4 oz/gallon of the reducing agent composition as described in Example 2, 5.4 oz/gallon of sodium hydroxide, and 3.0 oz/gallon of a 35% solution of acetaldehyde-bisulfite addition product.

Both textiles were dyed at steamer temperatures of about 110° C. The textiles were run through a continuous dye range at a rate of 100 yards per minute with 30 seconds skimming time.

The above dyeings were repeated using in the chemical pad, 5.4 oz/gallon sodium dithionite and 5.4 oz/gallon sodium hydroxide, as control, and the following results were obtained:

Table 2

| | Reducing Agent | |
|---|---|---|
| | Invention | Control |
| A. Terry Cloth | | |
| Wet Crock AATCC Test Rating | 4–5 | 3–4 |
| No. 4 Wash Fastness AATCC Test Rating | 4–5 | 3–4 |
| B. Corduroy and Twill Blend | | |
| Wet Crock AATCC Test Rating | 4–5 | 3–4 |
| No. 4 Wash Fastness AATCC Test Rating | 4–5 | 3–4 |

The results show the superiority of the reducing agent composition of the invention as compared with the control. In addition, color yield increased about 20–25% with the invention as compared with the sodium dithionite control.

The following dyes can be used to obtain similar results under the conditions specified above: Vat Blue #6; Vat Green #1, #3; Vat Black #25, #27; Vat Brown #1, #3, #11; Vat Yellow #2; and Vat Orange #2, #15.

EXAMPLE 4

The reducing agent composition prepared as in Example 2 was used to dye cotton with indigo dyes according to the Beck process. The following materials were added to five 600 gallon tanks: 0.4 oz/gallon of indigo powder, 2.5 oz/gallon of sodium hydroxide, 0.4 oz/gallon of the reducing agent composition and 0.4 oz/gallon of a 35% solution of acetaldehydebisulfite addition product. The cotton sample was continuously dyed at a rate of 35 yards per minute with a 30 second dwell time and a 90 second skying time for each tank. Dyeings with the invention reducing agent composition were compared with those using the sodium dithionite control.

The color yield increase with the invention was 35–50% higher with the invention than with the sodium dithionite control.

EXAMPLE 5

The stability of the reducing agent composition of the invention was determined by the following experiment. To a 50 ml beaker having a thermometer, the following items were added successively: solid reducing agent (20 gm), water (1 gm), and solid reducing agent (20 gm). Three reducing agents were tested: sodium dithionite (90% pure) as a control, sodium dithionite (70% pure) as a control, and a reducing agent composition of the invention comprising sodium dithionite (70% pure) and 7% of crystalline sodium hydroxymethanesulfinate. The sodium dithionite used in all three cases contained sodium carbonate and sodium chloride. Temperature readings were taken after the second addition of reducing agent, and 10 and 20 minutes, thereafter. Table 3 lists the temperature measurements for the three reducing agents tested.

Table 3

| Reducing Agent | Temperature at Time 0 | 10 min. | 20 min. |
|---|---|---|---|
| 90% sodium dithionite (control) | 25° C. | 47° C. | 84° C. |
| 70% sodium dithionite (control) | 25° C. | 38° C. | 78° C. |
| Invention | 25° C. | 29° C. | 43° C. |

The temperature increases for the sodium dithionite controls indicate their rapid decomposition relative to the reducing agent composition of the invention which contains the additional component, sodium hydroxymethanesulfinate.

EXAMPLE 6

A laboratory, long bath process of dyeing cotton with indigo dye was performed in the laboratory to illustrate the increase in color yield with the addition of sodium hydroxymethanesulfinate to sodium dithionite within the critical range. A 5 gm skein of cotton was dyed with indigo in 100 ml dye solution at 35° C. for 30 minutes. The following materials were added to the dyebath: 0.45 gm indigo, 2.5 gm sodium dithionite, and 2.5 gm sodium hydroxide. The amount of sodium hydroxymethanesulfinate added was varied from none (control) to 0.25 gm, representing 0 to 10% by weight, respectively, of the sodium dithionite.

Table 4

| Amount of sodium hydroxymethanesulfinate | Color yield increase |
|---|---|
| none (control) | — |
| 0.05 gm (2%) | 4% |
| 0.10 gm (4%) | 8% |
| 0.15 gm (6%) | 12% |
| 0.20 gm (8%) | 16% |
| 0.25 gm (10%) | 20% |

As shown in Table 4, the color yield increased by 4, 8, 12, 16 and 20%, respectively, with the addition of sodium hydroxymethanesulfinate.

The above procedure was repeated to illustrate the effect of the acetaldehyde-bisulfite addition product. A reducing agent composition comprising 2.5 gm sodium dithionite and 0.15 gm sodium hydroxymethanesulfinate (6%) was prepared. One, 2 and 3 grams, respectively, of a 35% solution of acetaldehyde-bisulfite addition product were added to the dyebaths. The color yield observed was compared with that using the sodium dithionite control and the results are listed in Table 5.

Table 5

| Reducing Agent | Color yield increase |
|---|---|
| Sodium dithionite control | — |
| Reducing agent composition of the invention with acetaldehyde bisulfite addition product as follows: | |
| 1 gm | 20% |
| 2 gm | 35% |
| 3 gm | 35% |

The effect of the acetaldehyde-bisulfite addition product was also demonstrated with the pad-steam process to dye terry cloth with Vat Blue #6. A reducing agent composition of the invention containing 6% sodium hydroxymethanesulfinate and 40% acetaldehyde-bisulfite addition product resulted in an increase in color yield of 25% as compared with the sodium dithionite control.

Having set forth the general nature and specific embodiments of the present invention, the true scope of the invention is now particularly pointed out in the appended claims.

We claim:

1. A reducing agent composition for dyeing a cellulosic textile with a vat and sulfur dye which comprises about 85–97.5% by weight of sodium dithionite and about 2.5–15% by weight of sodium hydroxymethanesulfinate.

2. The reducing agent composition according to claim 1 which comprises about 90–95% by weight of sodium dithionite and about 5–10% by weight of sodium hydroxymethanesulfinate.

3. The reducing agent composition according to claim 1 which further comprises about 5–15% sodium carbonate by weight of the composition.

4. The reducing agent composition according to claim 1 which further comprises a sufficient amount of water to provide an aqueous solution with about 2.5–15% of the reducing agent composition.

5. The reducing agent composition according to claim 1 which further comprises about 10–70% of an aldehyde-bisulfite addition product by weight of the composition.

6. The reducing agent composition according to claim 5 which comprises the acetaldehyde-bisulfite addition product.

7. A reducing agent composition for dyeing a cellulosic textile with a vat and sulfur dye which comprises about 90–95% by weight sodium dithionite, about 5–10% by weight sodium hydroxymethanesulfinate; said composition comprising about 5–15% by weight of sodium carbonate, and said composition further comprising about 10–70% by weight of acetaldehyde-bisulfite addition product.

8. In an improved process for dyeing a cellulosic textile with a vat and sulfur dye, the improvement which comprises adding a reducing agent composition comprising about 85–97.5% by weight of sodium dithionite and about 2.5–15% by weight of sodium hydroxymethanesulfinate.

9. The process according to claim 8 wherein the reducing agent composition comprises about 90–95% by weight of sodium dithionite and about 5–10% by weight of sodium hydroxymethanesulfinate.

10. The process according to claim 8 wherein the reducing agent composition comprises about 5–15% sodium carbonate by weight of the composition.

11. The process according to claim 8 wherein the reducing agent composition comprises a sufficient amount of water to provide an aqueous solution in about 2.5–15% of the reducing agent composition.

12. The process according to claim 8 wherein the reducing agent composition comprises about 10–70% of an aldehyde-bisulfite addition product by weight of the composition.

13. The process according to claim 12 wherein the reducing agent composition comprises the acetaldehyde-bisulfite addition product.

14. In an improved process for dyeing a cellulosic textile with a vat and sulfur dye, the improvement which comprises adding a reducing agent composition comprising about 90–95% by weight sodium dithionite and about 5–10% by weight sodium hydroxymethanesulfinate, said composition comprising about 5–15% by weight of sodium carbonate, and said composition further comprising about 10–70% by weight of acetaldehyde-bisulfite addition product is used.

15. The process according to claim 8 wherein the dye is indigo.

16. The process according to claim 12 wherein the dye is indigo.

* * * * *